United States Patent [19]

Maruyama et al.

[11] Patent Number: 4,579,702

[45] Date of Patent: Apr. 1, 1986

[54] ZINC OXIDE VOLTAGE NONLINEAR RESISTORS

[75] Inventors: Satoshi Maruyama; Koichi Tsuda; Kazuo Mukae; Ikuo Nagasawa, all of Kanagawa, Japan

[73] Assignee: Fuji Electric Company Ltd., Kanagawa, Japan

[21] Appl. No.: 761,314

[22] Filed: Jul. 30, 1985

Related U.S. Application Data

[63] Continuation of Ser. No. 539,786, Oct. 7, 1983, abandoned.

[30] Foreign Application Priority Data

Oct. 7, 1982 [JP] Japan ..... 57-176591

[51] Int. Cl.[4] ..... H01B 1/06

[52] U.S. Cl. ..... 264/56; 252/518; 252/519; 252/521; 338/21

[58] Field of Search ..... 264/61, 56; 252/521, 252/519, 518; 338/21

[56] References Cited

U.S. PATENT DOCUMENTS

| | | | |
|---|---|---|---|
| 3,663,458 | 5/1972 | Masuyama et al. | 252/521 |
| 3,903,226 | 9/1975 | Iga et al. | 264/61 |
| 3,928,245 | 12/1975 | Fishman | 252/521 |
| 4,028,277 | 6/1977 | Matsuura et al. | 252/521 |
| 4,046,847 | 9/1977 | Kresge | 264/61 |
| 4,320,379 | 3/1982 | Yodogawa | 252/521 |
| 4,386,022 | 5/1983 | Nagasawa et al. | 252/519 |
| 4,473,812 | 9/1984 | Maruyama et al. | 252/519 |
| 4,477,793 | 10/1984 | Mukae et al. | 252/521 |

FOREIGN PATENT DOCUMENTS

| | | | |
|---|---|---|---|
| 4019198 | 2/1979 | Japan | 252/521 |
| 4108297 | 8/1979 | Japan | 252/521 |
| 6152205 | 11/1981 | Japan | 252/521 |
| 6152206 | 11/1981 | Japan | 252/521 |
| 6152207 | 11/1981 | Japan | 252/521 |

*Primary Examiner*—James Derrington

*Attorney, Agent, or Firm*—Sughrue, Mion, Zinn, Macpeak, and Seas

[57] ABSTRACT

A zinc oxide voltage-nonlinear resistor is described. The resistor is produced by sintering a zinc oxide mixture containing 0.08 to 5.0 atomic % of at least one rare earth element, 0.1 to 10.0 atomic % of cobalt, 0.01 to 1.0 atomic % of at least one member of potassium, cesium, and rubidium, 0.01 to 1.0 atomic % of chromium, and $5\times10^{-4}$ to $1\times10^{-1}$ atomic % of boron, the balance being zinc oxide. This resistor has superior voltage nonlinearity and is greatly improved in the short duration discharge current withstand capability and the life performance under application of electricity.

6 Claims, No Drawings

ZINC OXIDE VOLTAGE NONLINEAR RESISTORS

This is a continuation of application Ser. No. 539,786, filed 10/7/83, now abandoned.

FIELD OF THE INVENTION

The present invention relates to voltage-nonlinear resistors. More particularly, the present invention is concerned with voltage-nonlinear resistors mainly comprised of zinc oxide (ZnO) which are used as overvoltage protective elements.

BACKGROUND OF THE INVENTION

Varistors mainly comprised of silicon carbide (SiC), selenium (Se), silicon (Si), or zinc oxide (ZnO) have heretofore been used for the purpose of protecting electric and electronic devices from overvoltage. In particular, variators containing ZnO as a major component, which are described, for example, in U.S. Pat. No. 3,663,458, generally have advantages in that the limiting voltage is low and the voltage-nonlinear exponent is large. For this reason, they are suitable for use in the protection from overvoltage of electric or electronic devices comprising devices, such as semiconductors, having a low overcurrent withstand capacity and, therefore, have been increasingly used in place of varistors made of SiC.

It is known from Japanese Patent Publication No. 22125/81, Japanese Patent Application (OPI) Nos. 152205/81, 152206/81 and 152207/81, etc. (The term "OPI" as used herein refers to a "published unexamined Japanese Patent Application") that voltage-nonlinear resistors produced by adding a rare earth element, cobalt (Co), at least one element of potassium (K), rubidium (Rb), and cesium (Cs), and further chromium (Cr) in the form of element or compound to ZnO as a major component and sintering the resulting mixture are superior in voltage-nonlinearity. These voltage-nonlinear resistors, however, have disadvantages in that their short duration discharge current withstand capability is slightly low, and also their life performance under application of electricity are low. Thus, they give rise to problems in the miniaturization of elements.

The present invention is intended to elucidate the mechanism of breakdown of elements due to short duration discharge current and further to realize the inhibition of breakdown, and simultaneously to provide voltage-nonlinear resistors which have improved life performance under application of electricity, are of small size, and are superior in high short duration discharge current withstand capability and life performance under application of electricity.

It has been found that with conventional voltage-nonlinear resistors made of ZnO as a major component, and a rare earth element, Co, at least one element of K, Cs, and Rb, and Cr, when a large scale of short duration discharge current is applied, the concentration of electric field at the peripheral portion of an electrode provided on the surface of an element causes current concentration, and that the current concentration brings about the breakdown of the element. Furthermore, it has been confirmed that there are local uneven portions in the interior of the resistor, and it has been found that when a direct current is passed, the concentration of current at the uneven portions occurs, causing deterioration in characteristics.

SUMMARY OF THE INVENTION

As a result of investigations to overcome the foregoing problems, it has been found that when boron (B) is added as an additional constituent, the resistance of the peripheral portion of an element becomes slightly higher than that of the interior thereof, and that such an increase in the resistance of the peripheral portion prevents the concentration of current in the peripheral portion of an electrode making it possible to increase the short duration discharge current withstand capability. Furthermore, it has been found that there can be obtained a voltage-nonlinear resistor in which the unevenness in the interior of the resistor is eliminated, and the life performance under application of electricity is greatly increased.

The present invention relates to a voltage-nonlinear resistor which is produced by sintering a zinc oxide mixture consisting of 0.08 to 5.0 atomic % of at least one rare earth element, 0.1 to 10.0 atomic % of cobalt, 0.01 to 1.0 atomic % of at least one of potassium, cesium, and rubidium, 0.01 to 1.0 atomic % of chromium, and $5\times10^{-4}$ to $1\times10^{-1}$ atomic % of boron, the balance being zinc oxide.

That is, the voltage-nonlinear resistor of the invention is produced from a mixture containing ZnO as a major component and, as additives, a rare earth element, Co, at least one element of K, Rb, and Cs, Cr, and further, B.

The unit "atomic %" as used herein refers to a percentage of the number of atoms in each metal element per the total number of atoms in all metal elements compounded to produce the desired voltage-nonlinear resistor.

The examples of rare earth element preferably involve lanthanum (La), praeseodymium (Pr), neodymium (Nd), samarium (Sm), terbium (Tb), and dysprasium (Dy).

Among potassium, cesium and rubidium, potassium is preferable.

The voltage-nonlinear resistor of the invention is generally produced by burning and sintering a mixture of ZnO and other metal or compound components at high temperatures in an oxygen-containing atmosphere.

Usually, metal elements as used herein are added in the form of metal oxide. In addition, compounds, such as carbonates, hydroxides, fluorides, and their solutions, which are capable of being converted into the corresponding oxides during a sintering process, can be used, or the components can be added in a metal element form and converted into the corresponding oxides in the sintering process.

In accordance with a particularly preferred procedure of the present invention, the voltage-nonlinear resistor is produced by adding the additive components in the form of metal or compound to ZnO powder, thoroughly mixing them, preliminarily calcining the mixture in air at 500° to 1,000° C. for several hours, fully grinding the preliminarily calcined product, molding the resulting powder in a predetermined form, and sintering the mold in air at a temperature of about 1,100° to 1,400° C. for several hours. At sintering temperatures lower than 1,100° C., sintering is insufficient and there is obtained a voltage-nonlinear resistor having instable characteristics. At higher temperatures than 1,400° C., a sintered product having uniform quality is difficult to obtain, voltage nonlinearity lowers, and reproductivity, e.g., control of characteristics, is poor. This makes it difficult to produce resistors suitable for practical use.

The following example is given to illustrate the invention in greater detail. However, the scope of the invention is not limited to this example.

EXAMPLE

To ZnO powder were added $Pr_6O_{11}$, $Co_3O_4$, $K_2CO_3$, $Cr_2O_3$ and $B_2O_3$ powders in the amounts corresponding to the predetermined atomic percents shown in Table 1, and they were thoroughly mixed and preliminarily calcined at 500° to 1,000° C. for several hours. The thus-prelimarily calcined product was thoroughly ground. A binder was added thereto, and the resulting mixture was press molded in a disc form and sintered in the air at 1,100° to 1,400° C. for one hour to obtain a sintered product. The thus-obtained sintered product was ground to obtain a 2 mm thick specimen. To both surfaces of the specimen were attached electrodes by baking to obtain an element. The electric characteristics of the element were measured.

With regard to the electric characteristics, a voltage between electrodes, $V_{1mA}$, when passing a current of 1 mA through the element at 25° C., a nonlinear exponent, $\alpha$, over a range of 1 to 10 mA, and, as a short duration discharge current withstand capability, a change in $V_{1mA}$ between before and after applying twice an impact current of $4\times10$ μsec and 65 kA were determined. In addition, as life performance under application of electricity, a direct current of 100 mA was passed for 5 minutes, and a change in the voltage between electrodes, $V_{1\mu A}$, when passing a current of 1 μA was measured. The nonlinearity exponent $\alpha$ was obtained by simulating the change of an element current I in relation to a voltage V to the following equation:

$$I=(V/C)^{\alpha}$$

(wherein C is a voltage of the element per unit thickness at a current density of 1 mA/cm$^2$).

The results of measurement of the electric characteristics when the composition of the voltage-nonlinear resistor was changed are shown in FIG. 1. The composition is shown in atomic % which is calculated from the ratio of the number of atoms in each metal element to the total amount of atoms in all metal elements.

TABLE 1

| Run No. | Components Pr | Co | K | Cr | B | $V_{1mA}$ (V) | Nonlinear Exponent $\alpha$ | Short Duration Discharge Current Withstand Capability $\Delta V_{1mA}$ (%) | Life Performance under Application of Electricity $\Delta V_{1\mu A}$ (%) |
|---|---|---|---|---|---|---|---|---|---|
| 1* | 0.10 | 5.0 | 0.1 | 0.1 | 0 | 321 | 32 | −64.3 | −35.4 |
| 2 | 0.01 | " | " | " | 0.010 | 213 | 23 | −35.1 | −37.3 |
| 3 | 0.08 | " | " | " | " | 232 | 31 | −9.2 | −6.7 |
| 4 | 0.10 | " | " | " | " | 264 | 43 | −3.1 | −5.2 |
| 5 | 0.50 | " | " | " | " | 285 | 47 | −2.5 | −2.6 |
| 6 | 1.0 | " | " | " | " | 312 | 48 | −4.2 | −4.1 |
| 7 | 5.0 | " | " | " | " | 430 | 42 | −19.3 | −11.5 |
| 8* | 7.0 | " | " | " | " | 441 | 45 | −46.2 | −38.1 |
| 9* | 0.10 | 0.05 | " | " | " | 215 | 21 | −68.1 | −38.5 |
| 10 | " | 0.10 | " | " | " | 272 | 33 | −14.8 | −18.2 |
| 11 | " | 0.50 | " | " | " | 245 | 31 | −3.1 | −5.7 |
| 12 | " | 1.0 | " | " | " | 271 | 33 | −3.8 | −4.2 |
| 13 | " | 10.0 | " | " | " | 347 | 27 | −15.1 | −14.2 |
| 14* | " | 15.0 | " | " | " | 362 | 17 | −87.2 | −68.2 |
| 15* | " | 5.0 | 0.005 | " | " | 295 | 14 | −45.2 | −36.4 |
| 16 | " | " | 0.01 | " | " | 332 | 25 | −9.3 | −12.5 |
| 17 | " | " | 0.05 | " | " | 353 | 28 | −6.4 | −4.1 |
| 18 | " | " | 0.1 | " | " | 371 | 35 | −3.5 | −3.2 |
| 19 | " | " | 0.2 | " | " | 382 | 37 | −2.2 | −2.8 |
| 20 | " | " | 1.0 | " | " | 445 | 33 | −10.1 | −9.3 |
| 21* | " | " | 2.0 | " | " | 472 | 45 | −27.7 | −43.1 |
| 22* | " | " | 0.1 | 0.005 | " | 485 | 17 | −25.5 | −47.5 |
| 23 | " | " | " | 0.01 | " | 391 | 25 | −3.2 | −10.2 |
| 24 | " | " | " | 0.5 | " | 362 | 31 | −8.4 | −8.3 |
| 25 | " | " | " | 1.0 | " | 314 | 37 | −17.4 | −19.7 |
| 26* | " | " | " | 2.0 | " | 296 | 34 | −28.5 | −43.5 |
| 27* | " | " | " | 0.1 | 0.0001 | 305 | 35 | −39.6 | −38.5 |
| 28 | " | " | " | " | 0.0005 | 290 | 37 | −18.3 | −13.5 |
| 29 | " | " | " | " | 0.0010 | 275 | 43 | −11.5 | −7.6 |
| 30 | " | " | " | " | 0.0050 | 243 | 39 | −3.6 | −4.1 |
| 31 | " | " | " | " | 0.050 | 208 | 21 | −8.4 | −5.4 |
| 32 | " | " | " | " | 0.10 | 197 | 17 | −9.7 | −11.6 |
| 33* | " | " | " | " | 0.20 | 184 | 8 | −8.7 | −14.7 |

*Comparative Run

The sample of Run No. 1 of Table 1 corresponds to the conventional sintered product produced by adding only Pr, Co, K and Cr to ZnO, and its short duration discharge current withstand capability is −64.3%, its life performance under application of electricity is −31.5%, and its non-linearity exponent is 32.

The samples of Run Nos. 3–7, 10–13, 16–20, 23–25, and 28–33 are good in the short duration discharge current withstand capability; i.e., the ratio of change of $V_{1mA}$ is near 0% rather than −64.3%, and are improved in the life performance under application of electricity; i.e., the ratio of change of $V_{1\mu A}$ is near 0% rather than −35.4%. Of these samples, the sample of Run No. 33 has a non-linearity exponent $\alpha$ which is not suitable for practical use. Accordingly, it is necessary that Pr be added within the range of from 0.08 to 5.0 atomic %, Co within the range of from 0.1 to 10 atomic %, K within the range of from 0.01 to 1.0 atomic %, Cr within the range of from 0.01 to 1.0 atomic %, and B within the range of from $5\times10^{-4}$ to $1\times10^{-1}$ atomic %.

As can be seen from Table 1, the addition of B to a system containing Pr, Co, K, and Cr as the additive components greatly improves the short duration discharge current withstand capability, and the life performance under application of electricity. This is achieved only when all of Pr, Co, K, Cr, and B are present in combination with ZnO. When Pr, Co, K, Cr, and B are added alone, the voltage-nonlinearity is very poor and there are obtained only ohmic characteristics, and therefore, the resulting resistor is not suitable for practical use.

In Table 1, only the results of those samples containing Pr as a rare earth element are shown. The effect of adding B to the systems in which a rare earth element other than Pr, or two or more of the rare earth metal elements are added is demonstrated in Table 2.

TABLE 2

| Run No. | Components: Rare Earth Element Element | Atomic % | Co | K | Cr | B | $V_{1mA}$ (V) | Non-linearity Exponent $\alpha$ | Short Duration Discharge Current Withstand Capability $\Delta V_{1mA}$ (%) | Life Performance under Application of Electricity $\Delta V_{1\mu A}$ (%) |
|---|---|---|---|---|---|---|---|---|---|---|
| 34 | Tb | 1.0 | 1.0 | 0.1 | 0.1 | 0.005 | 335 | 35 | −8.4 | −10.1 |
| 35 | | " | " | " | " | 0.01 | 314 | 31 | −3.2 | −6.4 |
| 36 | | " | " | " | " | 0.05 | 155 | 18 | −3.1 | −5.4 |
| 37 | La | " | 2.0 | " | " | 0.005 | 303 | 29 | −6.4 | −9.6 |
| 38 | | " | " | " | " | 0.01 | 254 | 24 | −2.7 | −4.7 |
| 39 | | " | " | " | " | 0.05 | 134 | 22 | −2.5 | −4.2 |
| 40 | Nd | " | 5.0 | " | " | 0.005 | 297 | 37 | −9.4 | −12.1 |
| 41 | | " | " | " | " | 0.01 | 225 | 22 | −3.5 | −5.1 |
| 42 | | " | " | " | " | 0.05 | 134 | 18 | −3.7 | −7.1 |
| 43 | Sm | " | " | " | " | 0.005 | 314 | 33 | −8.9 | −9.6 |
| 44 | | " | " | " | " | 0.01 | 266 | 27 | −4.3 | −4.3 |
| 45 | | " | " | " | " | 0.05 | 169 | 19 | −4.2 | −3.9 |
| 46 | Dy | " | 1.0 | " | " | 0.005 | 301 | 38 | −7.8 | −8.5 |
| 47 | | " | " | " | " | 0.01 | 275 | 26 | −3.4 | −4.2 |
| 48 | | " | " | " | " | 0.05 | 224 | 21 | −3.2 | −3.1 |
| 49 | Pr + La | 0.5 + 0.5 | " | " | " | 0.005 | 313 | 32 | −8.1 | −9.2 |
| 50 | | " | " | " | " | 0.01 | 275 | 27 | −2.7 | −3.2 |
| 51 | | " | " | " | " | 0.05 | 214 | 20 | −3.0 | −4.2 |

It can be seen from Table 2 that in cases in which rare earth elements other than Pr are used the short duration discharge current withstand capability, and the life performance under application of electricity can be greatly improved without losing the superrior nonlinearity.

Table 3 shows the characteristics of voltage-nonlinear resistors produced using Rb or Cs in place of K, and Table 4 shows the characteristics of voltage-nonlinear resistors produced using both Rb and Cs in combination with K.

TABLE 3

| Run No. | Components: Alkali Element Element | Atomic % | Pr | Co | Cr | B | $V_{1mA}$ (V) | Non-linearity Exponent $\alpha$ | Short Duration Discharge Current Withstand Capability $\Delta V_{1mA}$ (%) | Life Performance under Application of Electricity $\Delta V_{1\mu A}$ (%) |
|---|---|---|---|---|---|---|---|---|---|---|
| 52 | Cs | 0.01 | 0.1 | 5.0 | 0.1 | 0.010 | 247 | 19 | −10.2 | −9.1 |
| 53 | | 0.02 | " | " | " | " | 254 | 25 | −9.6 | −6.3 |
| 54 | | 0.05 | " | " | " | " | 285 | 31 | −8.1 | −3.9 |
| 55 | | 0.1 | " | " | " | " | 325 | 35 | −4.3 | −4.2 |
| 56 | | 0.5 | " | " | " | " | 331 | 33 | −3.2 | −7.1 |
| 57 | | 1.0 | " | " | " | " | 347 | 36 | −8.4 | −8.7 |
| 58 | Rb | 0.01 | " | " | " | " | 261 | 20 | −9.6 | −8.1 |
| 59 | | 0.02 | " | " | " | " | 285 | 26 | −6.4 | −5.3 |
| 60 | | 0.05 | " | " | " | " | 307 | 30 | −2.6 | −3.2 |
| 61 | | 0.1 | " | " | " | " | 318 | 35 | −2.4 | −2.6 |
| 62 | | 0.5 | " | " | " | " | 335 | 31 | −5.6 | −7.4 |
| 63 | | 1.0 | " | " | " | " | 364 | 34 | −8.7 | −9.5 |

TABLE 4

| Run No. | Components: Pr | Co | K | Rb | Cs | Cr | B | $V_{1mA}$ (V) | Non-linearity Exponent $\alpha$ | Short Duration Discharge Current Withstand Capability $\Delta V_{1mA}$ (%) | Life Performance under Application of Electricity $\Delta V_{1\mu A}$ (%) |
|---|---|---|---|---|---|---|---|---|---|---|---|
| 64 | 0.1 | 2 | 0.1 | 0.1 | 0.1 | 0.2 | 0.005 | 344 | 17 | −10.5 | −9.1 |
| 65 | " | " | " | " | " | " | 0.01 | 307 | 14 | −3.5 | −6.4 |
| 66 | " | " | " | " | " | " | 0.05 | 286 | 8 | −8.3 | −8.5 |
| 67 | 0.5 | " | " | " | " | " | 0.005 | 317 | 42 | −8.4 | −9.7 |
| 68 | " | " | " | " | " | " | 0.01 | 259 | 34 | −4.3 | −4.1 |
| 69 | " | " | " | " | " | " | 0.05 | 241 | 13 | −4.2 | −5.6 |
| 70 | 1 | " | " | " | " | " | 0.005 | 344 | 37 | −8.3 | −8.4 |
| 71 | " | " | " | " | " | " | 0.01 | 283 | 34 | −4.3 | −5.2 |
| 72 | " | " | " | " | " | " | 0.05 | 261 | 20 | −4.5 | −6.5 |
| 73 | 0.5 | 1.0 | " | " | " | " | 0.005 | 274 | 37 | −7.3 | −7.7 |
| 74 | " | " | " | " | " | " | 0.01 | 252 | 31 | −3.4 | −5.2 |
| 75 | " | " | " | " | " | " | 0.05 | 234 | 18 | −4.8 | −6.1 |
| 76 | " | 5.0 | " | " | " | " | 0.005 | 327 | 45 | −8.4 | −5.7 |

TABLE 4-continued

| Run No. | Components Pr | Co | K | Rb | Cs | Cr | B | $V_{1mA}$ (V) | Non-linearity Exponent α | Short Duration Discharge Current Withstand Capability $\Delta V_{1mA}$ (%) | Life Performance under Application of Electricity $\Delta V_{1\mu A}$ (%) |
|---|---|---|---|---|---|---|---|---|---|---|---|
| 77 | " | " | " | " | " | " | 0.01 | 287 | 26 | −3.2 | −3.8 |
| 78 | " | " | " | " | " | " | 0.05 | 254 | 14 | −3.5 | −7.4 |
| 79 | " | 2 | 0.2 | 0 | " | " | 0.05 | 331 | 40 | −9.2 | −8.9 |
| 80 | " | " | " | " | " | " | 0.01 | 264 | 35 | −4.9 | −7.1 |
| 81 | " | " | " | " | " | " | 0.05 | 242 | 20 | −4.8 | −6.3 |
| 82 | 0.2 | " | 0 | 0.2 | " | " | 0.05 | 313 | 37 | −8.3 | −9.1 |
| 83 | " | " | " | " | " | " | 0.01 | 251 | 31 | −3.5 | −4.9 |
| 84 | " | " | " | " | " | " | 0.05 | 234 | 18 | −3.3 | −5.6 |
| 85 | 0.5 | " | 0.2 | 0.1 | 0 | " | 0.05 | 293 | 42 | −9.2 | −8.7 |
| 86 | " | " | " | " | " | " | 0.01 | 281 | 31 | −2.8 | −5.2 |
| 87 | " | " | " | " | " | " | 0.05 | 243 | 17 | −3.6 | −7.1 |

In all cases, the addition of B makes it possible to greatly improve the short duration discharge current withstand capability and the life performance under application of electricity as is the case with the addition of K alone without losing the superior nonlinearity. In this case, it is necessary that a rare earth element be added in a range of from 0.08 to 5.0 atomic %, Co in a range of from 0.1 to 10.0 atomic %, at least one of K, Cs, and Rb in a range of from 0.01 to 1.0 atomic %, Cr in a range of from 0.01 to 1.0 atomic %, and B in a range of from $5\times10^{-4}$ to $1\times10^{-1}$ atomic %. This is achieved only when all of a rare earth element, at least one of K, Cs, and Rb, Cr, and B are present in combination with ZnO. When a rare earth element, at least one of K, Cs, and Rb, Cr, and B are used alone, the resulting voltage nonlinearity is very poor and there is obtained only ohmic characteristics, and therefore the resulting voltage nonlinear resistor is not suitable for practical use.

Voltage-nonlinear resistors produced using a mixture containing ZnO as a major component and further, Pr, Co, at least one of K, Cs, and Rb, Cr, and B as additive components are greatly improved in the short duration discharge current withstand capability and the life performance under application of electricity while holding their superior nonlinearity and, therefore, they are very suitable for use as varistors.

While the invention has been described in detail and with reference to specific embodiments thereof, it will be apparent to one skilled in the art that various changes and modifications can be made therein without departing from the spirit and scope thereof.

What is claimed is:

1. A method for producing a zinc oxide voltage-nonlinear resistor, comprising the steps of:

providing a mixture of components comprising 0.08 to 5.0 atomic % of a rare earth element, 0.1 to 10.0 atomic % of cobalt, 0.01 to 1.0 atomic % of an element selected from the group consisting of potassium, cesium, and rubidium, 0.01 to 1.0 atomic % of chromium, $5\times10^{-4}$ to $1\times10^{-1}$ atomic % of boron and the balance of the mixture being zinc oxide; and sintering the mixture to form a coherent mass.

2. A method for producing a zinc oxide voltage-nonlinear resistor as claimed in claim 1, wherein the components of the mixture are provided in the form of metal oxides.

3. A method for producing a zinc oxide voltage-nonlinear resistor as claimed in claim 1, wherein the components of the mixture are provided in a form selected from the group consisting of carbonates, hydroxides, fluorides and solutions thereof which are capable of being converted into corresponding oxides during the sintering.

4. A method for producing a zinc oxide voltage-nonlinear resistor, comprising the steps of:

providing a mixture of components comprising 0.08 to 5.0 atomic % of a rare earth element, 0.1 to 10.0 atomic % of cobalt, 0.01 to 1.0 atomic % of an element selected from the group consisting of potassium, cesium, and rubidium, 0.01 to 1.0 atomic % of chromium, $5\times10^{-4}$ to $1\times10^{-1}$ atomic % of boron and the balance of the mixture being zinc oxide;

thoroughly mixing the components;

subjecting the components to preliminary calcining in air at a temperature in the range of 500° to 1000° C. to provide a preliminary calcined product;

grinding the preliminarily calcined product to provide a powder;

molding the powder into a predetermined form; and sintering the predetermined form in air at a temperature in the range of 1100° to 1400° C.

5. A method for producing a zinc oxide voltage-nonlinear resistor as claimed in claim 4, wherein the components of the mixture are provided in the form of metal oxides.

6. A method for producing a zinc oxide voltage-nonlinear resistor as claimed in claim 4, wherein the components of the mixture are provided in a form selected from the group consisting of carbonates, hydroxides, fluorides and solutions thereof which are capable of being converted into corresponding oxides during the sintering.

* * * * *